US005184305A

United States Patent [19]

Gronenberg

[11] Patent Number: 5,184,305

[45] Date of Patent: Feb. 2, 1993

[54] METHOD AND APPARATUS FOR OPERATING AN AUTOMATIC TEXTILE MACHINE

[75] Inventor: Reinhard Gronenberg, Mönchengladbach, Fed. Rep. of Germany

[73] Assignee: W. Schlafhorst AG & Co., Mönchengladbach, Fed. Rep. of Germany

[21] Appl. No.: 621,627

[22] Filed: Dec. 3, 1990

[30] Foreign Application Priority Data

Dec. 1, 1989 [DE] Fed. Rep. of Germany ..... 3939789

[51] Int. Cl.[5] ..... G06F 15/46; D01H 13/14; B65H 67/06

[52] U.S. Cl. ..... 364/470; 364/187; 242/18 R; 242/35.5 A; 242/35.6 E

[58] Field of Search ..... 364/470, 187, 473, 469; 19/65 A, 0.23, 0.22, 0.21, 0.25, 0.26, 239, 300; 66/158, 163; 57/264, 81; 242/18 R, 35.5 A, 35.5 R, 35.6 E

[56] References Cited

U.S. PATENT DOCUMENTS

| | | | |
|---|---|---|---|
| 3,763,362 | 10/1973 | Griem, Jr. | 364/473 |
| 4,432,210 | 2/1984 | Saito | 364/187 |
| 4,576,340 | 3/1986 | Aretz et al. | 242/35.5 A |
| 4,584,833 | 4/1986 | Dykast et al. | 57/81 |
| 5,105,363 | 4/1992 | Dragon et al. | 364/469 |

FOREIGN PATENT DOCUMENTS

| | | |
|---|---|---|
| 3512063 | 11/1987 | Fed. Rep. of Germany . |
| 3716829 | 1/1988 | Fed. Rep. of Germany . |

*Primary Examiner*—Jerry Smith
*Assistant Examiner*—Steven R. Garland
*Attorney, Agent, or Firm*—Herbert A. Lerner; Laurence A. Greenberg

[57] ABSTRACT

A method and apparatus for operating a textile machine, such as an automatic bobbin winder or an automatic spinning machine, include subdividing a course of operation into individual operating steps; monitoring at least one of the operating steps with at least one sensor for detecting presence, absence or movement past the sensor of an article connected to the textile machine or success or failure of a provision or an operating step and tripping an automatic intervention into the course of operation as a function of the outcome of the detection. According to the method, the functional capability of the sensor is automatically monitored, and an automatic switch over takes place from the operating program to a prepared substitute program no longer requiring the sensor for continued operation of the textile machine after failure of the sensor. The apparatus includes a device connected to the at least one sensor for operating the textile machine according to an operating program and a predetermined substitute program assuring continued operation of the textile machine even if the at least one sensor has failed. A device is connected to the operating device for automatically monitoring capability of the at least one sensor. A switchover device is connected to the monitoring device for switching over textile machine operation from the operating program to the substitute program after a failure of the at least one sensor ascertained by the monitoring device.

22 Claims, 4 Drawing Sheets

METHOD AND APPARATUS FOR OPERATING AN AUTOMATIC TEXTILE MACHINE

BACKGROUND OF THE INVENTION

Field of the Invention

The invention relates to a method and an apparatus for operating a textile machine, in particular an automatic bobbin winder or automatic spinning machine, that operates automatically according to an operating program, in which a course of operation is subdivided into individual operating steps at least one of which is monitored by at least one sensor that has the task of sensor detection of the presence, absence, or passage past the sensor of an article remaining connected to the textile machine or the success or failure of a provision or an operating step, and of tripping an automatic intervention into the course of operation as a function of the outcome of the detection.

It is known for such automatic machines to run without supervision. In order to protect the automatic machine if any malfunction occurs, there is typically a provision for it to shut off automatically and issue an alarm signal. However, without constant supervision, the disruption and operation cannot be taken care of until the end of a shift or possibly even later. If the attendant loss in production is to be avoided, then one is forced to put even automatic textile machines under constant supervision and also to make provisions for the fastest possible resumption of operation. However, providing precisely for immediate resumption of operation often entails problems, because restarting requires furnishing the textile material over again, extensive preparation work, additional workers for restarting the machinery, and the like, to name only a few of the difficulties. Restarting also typically entails an initial loss in quality of the goods produced. When machines are run in interlocked operation, other textile machines and other machinery and operations also suffer from the failure of one automatic machine.

In modern textile machines, sensors are increasingly used to control the various operating steps. Not infrequently, such sensors fail and then cause stoppages in operation. It is true that it is often quite simple to replace a defective sensor when the machine is stopped, so that if the monitoring system for the operation reacts quickly, the damage caused by the down time may possibly be minimized, but still not prevented.

It is accordingly an object of the invention to provide a method and apparatus for operating an automatic textile machine, which overcome the hereinafore-mentioned disadvantages of the heretofore-known methods and devices of this general type and which reduce the number of interruptions in operation of an automatically operating textile machine.

SUMMARY OF THE INVENTION

With the foregoing and other objects in view there is provided, in accordance with the invention, a method for operating a textile machine, such as an automatic bobbin winder or an automatic spinning machine, that operates automatically according to an operating program, which comprises subdividing a course of operation into individual operating steps; monitoring at least one of the operating steps with at least one sensor having the task of detecting at least one of presence, absence or passage past the sensor of an article remaining connected to the textile machine or success or failure of a provision and an operating step and tripping an automatic intervention into the course of operation as a function of the outcome of the detection; automatically monitoring the functional capability of the sensor; and automatically switching over from the operating program to a prepared substitute program no longer requiring the sensor for continued operation of the textile machine after failure of the sensor.

In the simplest case, the substitute program can provide for placing a substitute sensor into operation, thus enabling continued operation of the textile machine without any restrictions. Naturally, it is practical to issue an alarm as well, so that the defective sensor will be replaced as quickly as possible. Once the sensor is replaced, a switch back to the operating program can be made, for instance manually. After replacement of the sensor, another option is to declare the substitute program in progress to be the operating program and to make the previous operating program the substitute program. Then the switchover would always be from one program to the other, and the designation as the substitute program would always apply to whichever program was not in progress at a given time.

The term "sensor" should be understood in this case in the broadest possible sense. It is intended to include any feelers, sensors or the like that can suitably monitor an operating step and can cause the switchover from one program to the other, either directly or indirectly, after responding.

Sensors can fail for the most varied reasons. In automatic textile machinery, one possible cause of sensor malfunction is that they become soiled in the course of time and gradually become inoperative. After a switchover to the substitute program, often it is merely necessary to clean a light barrier with a small brush, or to wipe off an optical sensor with a rag, or the like, in order to make the sensor ready for operation again. Under some circumstances this can be done by auxiliary workers while the machine is running, as long as the initial disposition of the sensors provides for safe access to them.

For various reasons it is not always possible to switch from a functionally impaired sensor to a substitute sensor. In the case where the sensor may become dirty, the substitute sensor may also already be dirty before it goes into operation, or there may simply be no room for a substitute sensor.

In order to obtain the advantages of the invention in this case as well, in accordance with another mode of the invention, there is provided a method which comprises defining the duration of an operating step in the context of the substitute program as being fixed or determined by different criteria, whenever the sensor had previously determined the instant of the end of the operating step or the beginning of a new operating step in the context of the operating program. For instance, the duration of an operating step can be monitored automatically, and if irregularities are ascertained, a switchover is made to the substitute program. In the substitute program, the duration of the operating step is then no longer determined by a sensor. It is simplest if a fixed duration of the operating step is specified, as long as a suitably long time tolerance is provided in order to be sure that under all circumstances the operating step can indeed be performed within the specified time. Instead of a fixed time specification, the time specification may also be flexible, for example as a function of the particular production speed of the textile machine, which of course can be generally adjustable either incrementally or in an infinitely graduated fashion. The flexible time specification would have the advantage of better adaptation to the particular performance of the automatic textile machine. The time specification could also be dependent on the type of textile material to be processed at a given time, or the like. These dependencies could automatically be incorporated into the substitute program beforehand when the operating parameters are set, so that an automatic specification of intrinsically flexible times could be made by known means suitable for such purposes.

In accordance with a further mode of the invention, there is provided a method which comprises integrating the programs for the operation of the textile machine by software into an electronic system equipped with at least one microprocessor, and switching over in the transition from the operating program to the substitute program by conventional software emulation. The use of circuits that enable software emulation are known in electronic data processing systems.

In accordance with an added mode of the invention, there is provided a method which comprises determining the duration of an operating step in the context of the operating program with a light barrier, and taking over the function of the light barrier with a timer mechanism in the context of the substitute program in the event of a failure of the light barrier. The term "light barrier" is intended to include opto-electric sensors of any kind. The term "timer mechanism" is intended to include time specification devices of any kind, particularly those that trip electrical switching processes after a period of time has elapsed.

With the objects of the invention in view, there is also provided an apparatus for operating a textile machine, in particular an automatic bobbin winder or automatic spinning machine, that operates automatically according to an operating program, comprising at least one sensor monitoring at least one individual operating step subdivided from a course of operation for performing the task of detecting at least one of presence, absence or passage past the sensor of an article remaining connected to the textile machine or the success or failure of a provision or an operating step and tripping an automatic intervention into the course of operation as a function of the outcome of the detection; means connected to the at least one sensor for operating the textile machine according to an operating program and according to a predetermined substitute program assuring continued operation of the textile machine even if the at least one sensor has failed; means connected to the operating means for automatically monitoring functional capability of the at least one sensor; and switchover means connected to the monitoring means for switching over textile machine operation from the operating program to the substitute program after a failure of the at least one sensor ascertained by the monitoring means.

The term "monitoring means" should be understood very broadly in this context. However, some monitoring means are given preference. For instance, in accordance with another feature of the invention, the at least one sensor is a first sensor, the monitoring means includes a second sensor with a given monitoring range, and the first sensor is disposed within the given monitoring range.

If the object of the invention is kept in mind, it is neither obvious or self-evident, or even superfluous, to have one sensor monitored by another. After all, both sensors could become dirty or inoperative in the course of time in the same way. However, the concept in this case is not primarily to have one sensor monitored by a second sensor of the same type, but rather that the monitoring sensor is in general of a kind that does not readily become dirty or tend to malfunction.

For example, if yarns are being monitored, this is done in a known manner by opto-electronic sensors. However, these sensors are quite sensitive. The light that a light transmitter of an opto-electric sensor emits, for instance, can be monitored according to the invention by a further sensor. However, this sensor does not need to be nearly as sensitive as the sensor monitoring the yarn. For the monitoring sensor it is often sufficient to merely distinguish between light and darkness or, for instance, to ascertain whether or not infrared light is present. A monitoring sensor that merely needs to perform this kind of simple task is immune to many kinds of malfunction.

In accordance with a further feature of the invention, the the monitoring means has an electric or an electronic circuit operatively connected to the sensor to be monitored. The circuits intended in this case are of any type, but the following examples are especially mentioned:

If the monitoring sensor has a light emitting diode, for instance, then the current flowing through the light emitting diode, or the voltage applied to the light emitting diode can, for instance, be measured continuously by means of an electronic circuit. If there is an interruption in the power supply, the electric or electronic switchover from the operating program to the substitute program is brought about by the monitoring sensor. If instead the monitoring sensor is located in the circuit of a phototransistor, a photo diode or a photoresistor, then the light emitted by the light emitting diode of the sensor to be monitored can be directly monitored continuously.

In accordance with an added feature of the invention, the monitoring means is a time switching mechanism that monitors the duration of the sensor-monitored operating step or one of its substeps. In that case, the presumption of a malfunction of the sensor must be made without monitoring the sensor directly, but this is also optional in this case, so that redundancy in monitoring is entirely possible as well.

In accordance with an additional feature of the invention, the at least one sensor provided in accordance with the operating program for limiting the duration of an operating step is replaced, according to the substitute program, by a non-sensor type of time specification means.

In accordance with again another feature of the invention, the non-sensor time specification means is a timer mechanism.

In accordance with a concomitant feature of the invention, the two programs for the operation of the textile machine are integrated by software into an electronic system equipped with at least one processor, and the electronic system includes a circuit or emulator that enables a software emulation for the transition from the operating program to its substitute program. Stored-program controls (SPCs) or microprocessor controls are examples of such suitable electronic systems.

Electronic systems are already known for operating automatic bobbin winders. The circuit or emulator that makes the software emulation possible can easily be added to this electronic system, if the system does not already include it.

Other features which are considered as characteristic for the invention are set forth in the appended claims.

Although the invention is illustrated and described herein as embodied in a method and apparatus for operating an automatic textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
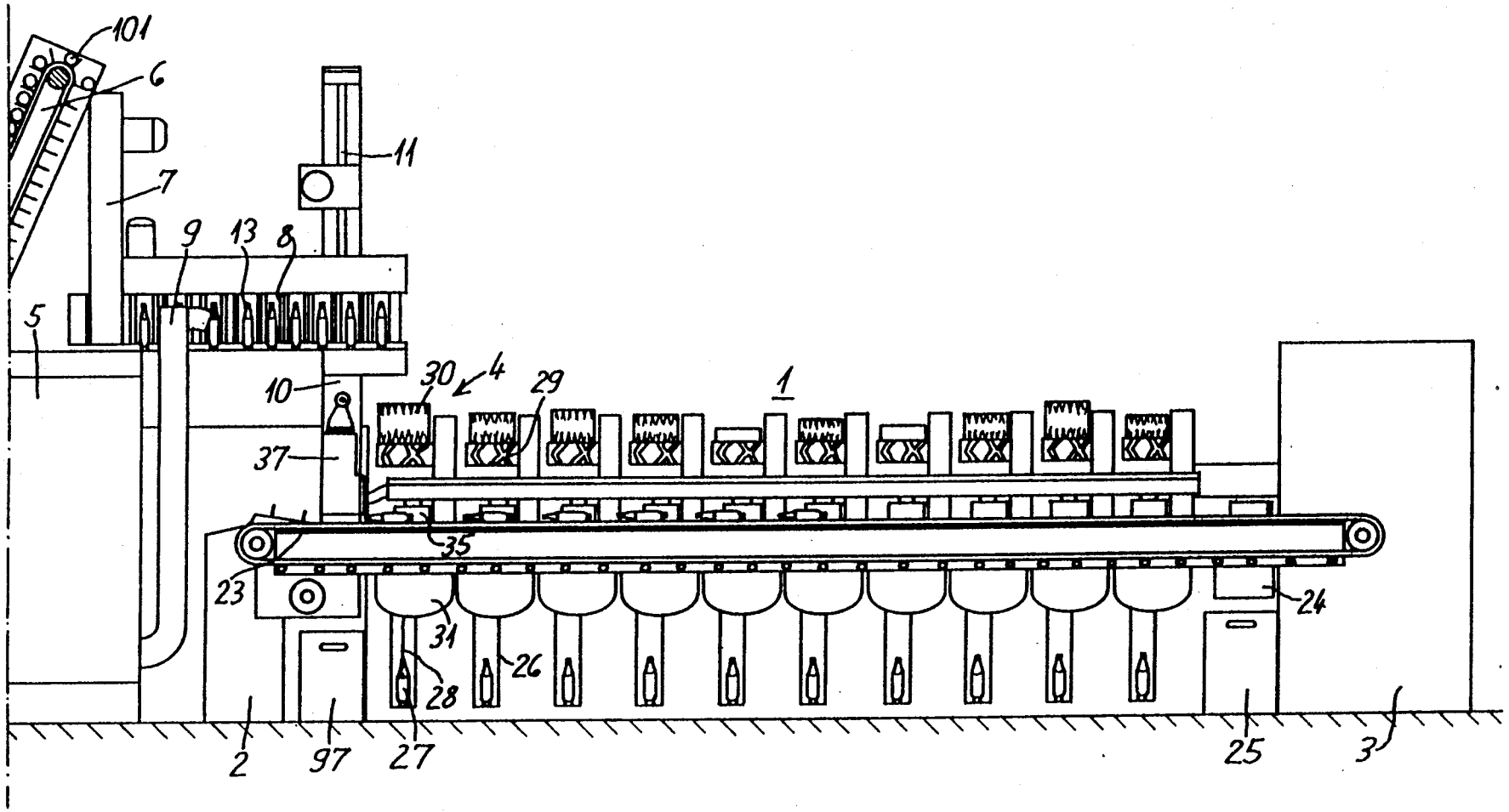
FIG. 1 is a fragmentary, diagrammatic, side-elevational view of an automatic bobbin winder with a cop preparation station.

Referring now to the figures of the drawings in detail and first, particularly, to FIG. 1 thereof, there are seen primary parts of a bobbin winder 1 in the form of a front end frame 2, a rear end frame 3, and ten identical winding stations 4 located between them. A cop preparation station represented overall by reference numeral 5 is set up next to the front end frame 2. The various parts of the cop preparation station that are visible in FIG. 1 are an elevator 6, a cop inverter 7, a cop conveyor belt 8, a blower apparatus 9 and a cop delivery station 10, to which an individual feeder 11 also belongs.

Figure 2:
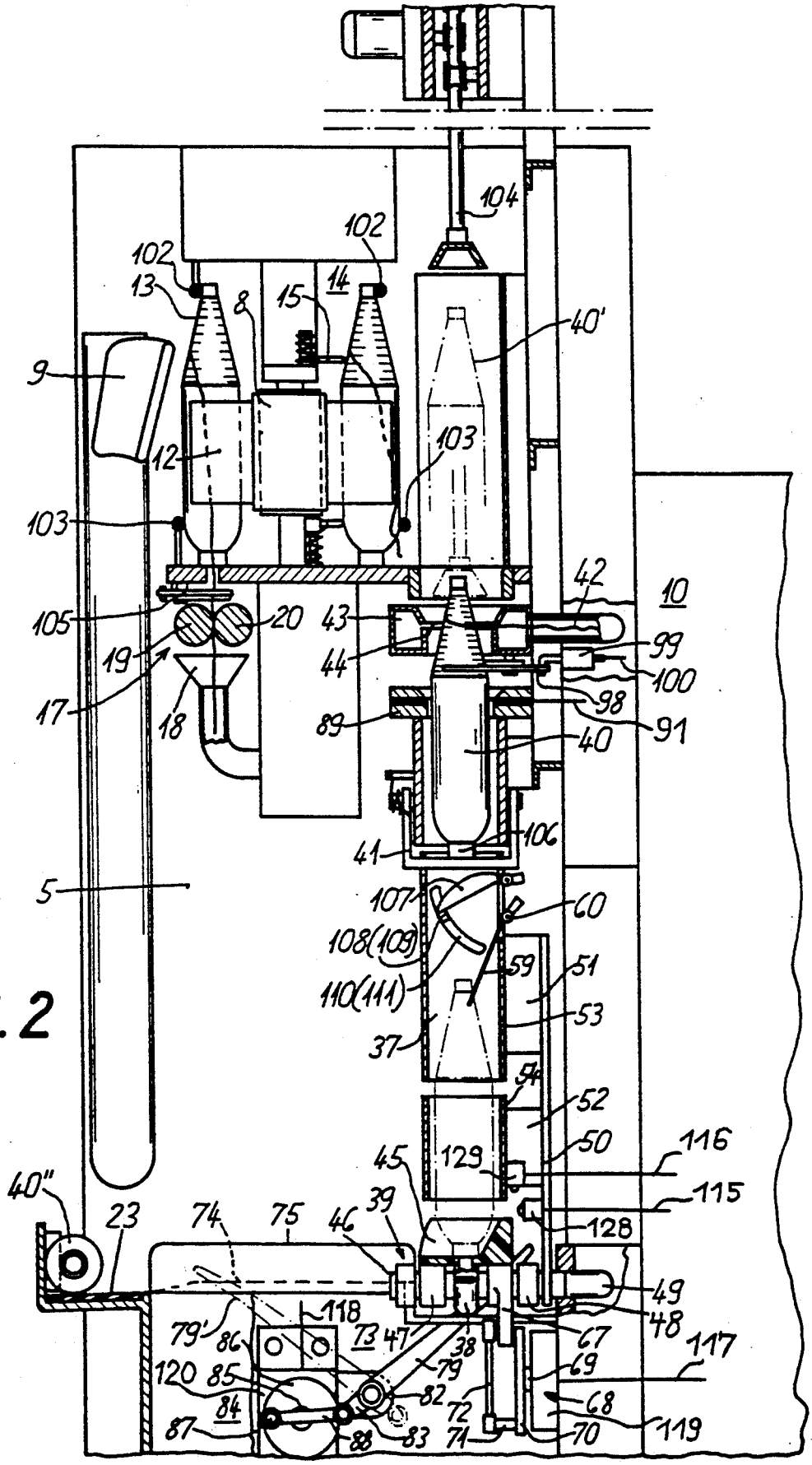
FIG. 2 is an enlarged, fragmentary, front-elevational view of the cop preparation station, with a drop chute being broken away.
Figure 3:
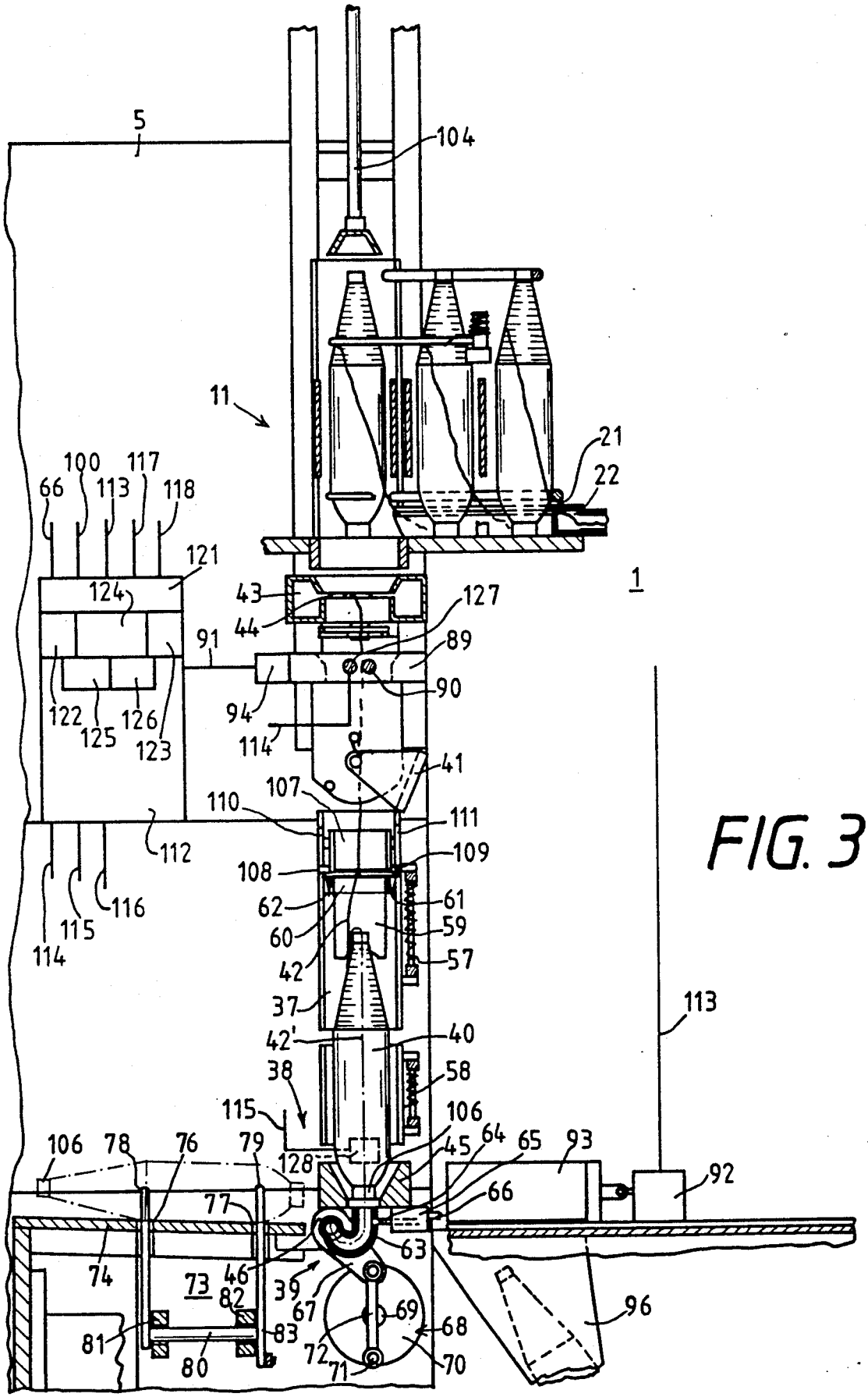
FIG. 3 is a fragmentary, front-elevational view of the drop chute and a horizontal conveyor connected to the output side thereof at the instant that suction begins.

FIG. 2 shows that the cop conveyor belt 8 carries spinning cops 13 which are located in individual pockets 12, to an inverting station 14, at which a controlled feeder 15 transfers one spinning cop after another to the cop delivery station 10. With the aid of the blower apparatus 9, yarn ends are blown downward along the surface of the cop, grasped there by an unwinder 17, pulled downward into a funnel 18 and pulled through it by suction. The unwinder 17 has two driven unwinder rollers 19 and 20. The yarn ends trailing from the various spinning cops 13 enter an intake slit 21 of a suction apparatus 22 at the inverting station 14, as seen in FIG. 3.

The cop preparation station 5 is followed by transport means 23 in the form of a conveyor belt. The transport means 23 are guided along the automatic bobbin winder 1 past the winding stations 4. Located at the end of the transport means 23 is an overflow configuration 24, which discharges into a collection box 25.

Figure 4:
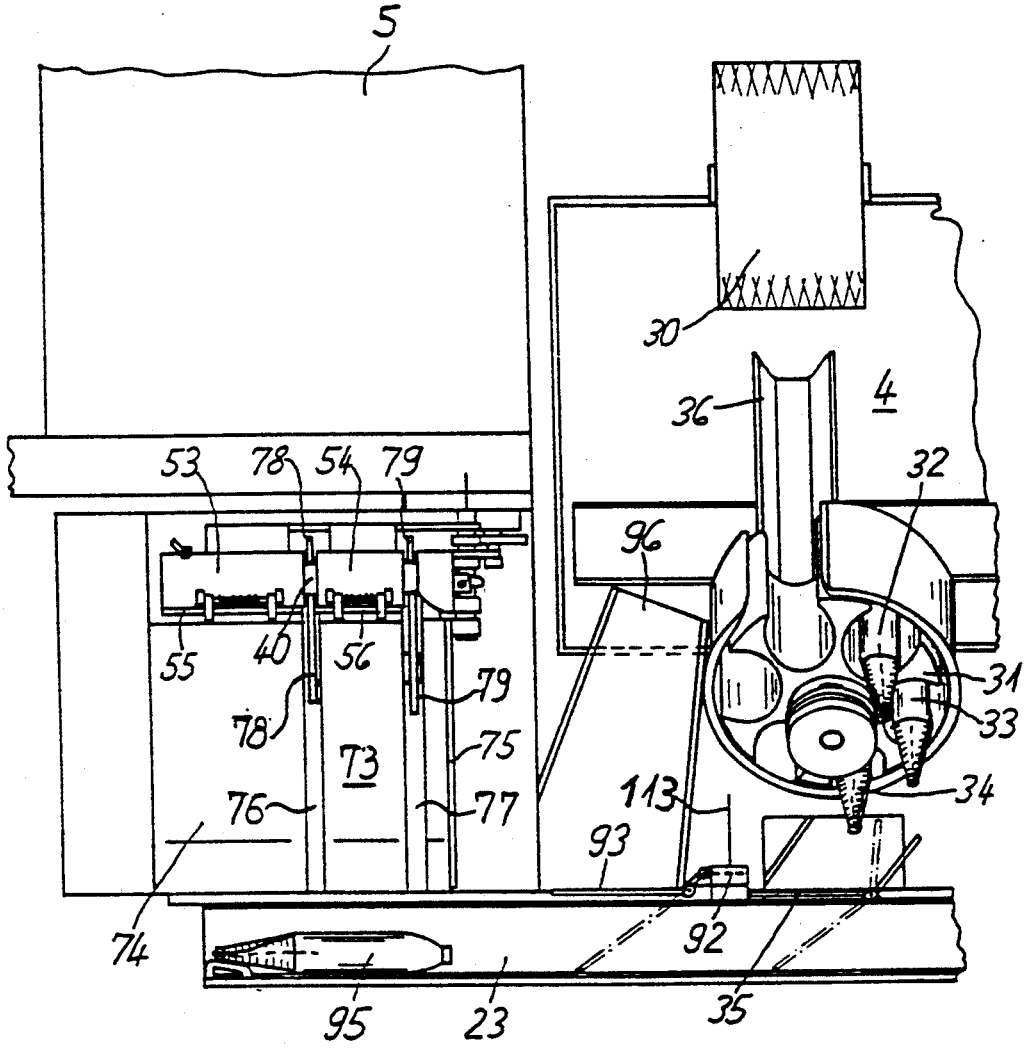
FIG. 4 is a fragmentary, top-plan and perspective view of the drop chute in the horizontal position and of a first winding station of the automatic bobbin winder.

The winding station 4 shown in FIG. 1 has a payout station 26, which is occupied by a payout bobbin 27. A yarn or thread 28 drawn from the payout bobbin 27 passes over a drive roller 29 provided with reversing thread grooves, to a windup bobbin 30 which is in the form of a cross-wound bobbin or cheese that rolls along the drive roller 29. As shown in FIGS. 1 and 4, a rotatable payout bobbin magazine 31 which is constructed as a round magazine, always keeps from two to three additional payout bobbins 32–34 in reserve at the winding station. The bobbins 32–34 are already prepared payout bobbins having yarn ends which have been threaded into bobbin tubes. A switchable shunt 35 makes it possible to divert a payout bobbin from the transport means 23 and to make it slide into an empty pocket of the payout bobbin magazine 31 whenever a payout bobbin has previously been delivered to the payout station 25 over a slide 36. All ten winding stations of the automatic bobbin winder 1 are constructed like the winding station 4.

A drop chute 37, which has a switchable suction apparatus 38 and a pivoting apparatus 39 at its lower end, is disposed between the cop delivery station 10 of the cop preparation station 5 and the transport means 23. The drop chute 37 is capable of receiving spinning cops in succession, for example a particular spinning cop 40 which is being held in reserve at the cop delivery station 10 in FIG. 2 and is later to be used as a payout bobbin in the automatic bobbin winder 1. The drop chute 37 is pivotable from an upright position into the horizontal position. In the present exemplary embodiment, the upright position can be considered equivalent to the vertical position.

A cop retainer 41 controllable by the drop chute 37 is disposed at the cop delivery station 10 of the cop preparation station 5. The cop retainer 41 is in the form of a rocker, which can be carried along with the drop chute 37 when the drop chute pivots back into the vertical position and is pivotable laterally outward, as shown in FIG. 3. FIG. 3 also shows that during this process the spinning cop 40 loses its contact with the cop retainer 41 and drops down into the drop chute 37. The yarn end 42 of the spinning cop 40 trails along after it in the process, because it is firmly held in a suction apparatus 43 that has an annular slit nozzle 44.

As is shown particularly in FIGS. 2–4, the drop chute 37 includes a plurality of parts. Disposed at the bottom of the chute 37 is a funnel 45, which is secured to a hollow shaft 46. The hollow shaft 46 is supported in two stationary bearing blocks 47, 48. The front end of the hollow shaft 46 is closed and the other end communicates with a source of suction through a suction line 49. A support 50 that has two crossbeams 51, 52 is welded to the hollow shaft 46. The crossbeam 51 is disposed above the crossbeam 52. The crossbeam 51 has an upper chute body 53, and the lower crossbeam 52 has a lower chute body 54. As seen in FIG. 4, toward the front the upper chute body 53 is closable by a flap 55 and the lower chute body 54 is closable by a flap 56. As seen in FIG. 3, the flap 55 is kept in the closing position by a coiled spiral spring 57 and the flap 56 is kept in the closing position by a coiled spiral spring 58. The interior of the drop chute 37 has an apparatus 59 for preventing layers of yarn from being knocked off. The apparatus 59 includes a flap that rests slightly resiliently against the surface of the cop. To this end, the flap 59 has a pivot shaft 60 that carries two coiled spiral springs 61, 62.

The suction apparatus 38 has a curved suction tube 63, which leads from the hollow shaft 46 to the bottom of the funnel 45. The suction apparatus 38 is switchable in the sense that the suction tube 63 can be closed by a controllable pair of yarn scissors 64. Simultaneously with the closure of the suction tube 63, a yarn end that may have been aspirated is severed by the yarn scissors 64. A control device of the yarn scissors 64, which is shown at reference numeral 65, is an electromagnetic control device of the solenoid type having a connection line 66 which is flexible.

The pivoting apparatus 39, to which the pivotable hollow shaft 46 belongs as already mentioned, has a lever 67 secured to the hollow shaft. The lever 67 is connected to a crank drive 68. The crank drive 68 serves as drive means but also as means for limiting the acceleration and deceleration of the cop 40 during the pivoting motion of the drop chute 37. The crank drive 68 includes a drive shaft 69 being drivable by a motor 119 seen in FIG. 2, a flywheel 70, a crank pin 71, and a connecting rod 72 that is pivotably connected to the lever 67.

A horizontal conveyor 73 is disposed between the drop chute 37 and the transport means 23. The horizontal conveyor 73 has an approximately horizontally disposed slide surface 74, which is limited by a side wall 75. Two slits 76, 77 are machined into the slide surface 74. The slits 76 and 77 serve as guides for two transport levers 78 and 79. As seen in FIG. 3, both transport levers 78, 79 are secured on one shaft 80 which is supported in bearing blocks 81, 82 below the slide surface 74. A lower extension 83 of the transport lever 79 is pivotably connected to a crank drive 84 seen in FIG. 2. The crank drive 84 has a drive shaft 85, which is drivable by a motor 120, a fly wheel 86 with a crank pin 87 secured to it, and a connecting rod 88, which is pivotably connected to the lower extension 83 of the transport lever 79. The horizontal conveyor 73 is disposed in such a way that its two transport levers 78 and 79 can pivot past the chute body 54 to its right and left whenever the drop chute 37 is in the horizontal position, as shown in FIG. 4.

The crank drive 84 serves as a drive apparatus for the horizontal conveyor 73 but also serves as a means for limiting the acceleration and deceleration of the spinning cop to be transported.

A sensor 89 for the presence of yarn is disposed above the cop retainer 41. The yarn presence sensor 89 has an opto-electric light barrier 90. An operative connection 91 leads from the yarn presence sensor 89 to an electronic data processing system 112, which will be described in further detail below. An operative connection 113 leads from a sequencer 121 to an electromagnetic actuating device 92 of a cop diversion shunt 93. The yarn presence sensor 89 is activatable in delayed fashion upon release of the retained spinning cop 40 seen in FIG. 2, because of the fact that it is simultaneously constructed as a feeler for the presence of a cop and to this end has a combined switchover and delay device 94, which switches over from cop measurement to yarn measurement upon cessation of a cop presence signal and after a set delay period has elapsed. If no yarn can be ascertained at the instant of yarn measurement, the cop diversion shunt 93 should be automatically set to diversion, as represented by phantom lines in FIG. 4. From the missing yarn, it can be expected that the spinning cop in question, for example a cop 95 in FIG. 4, cannot be correctly prepared. This spinning cop is then diverted over a slide 96 and can be collected in a collecting container 97 seen in FIG. 1 or automatically returned to the cop preparation station 5.

A controllable pair of yarn remnant scissors 98 is disposed between the suction apparatus 43 and the yarn presence sensor 89. The yarn remnant scissors 98 have the task of shortening the trailing yarn end to a certain length, once the yarn presence sensor 89 has ascertained the presence of the trailing yarn end. The yarn remnant scissors 98 should therefore be controlled by the yarn presence sensor 89 through the electronic data processing system 112. To this end, an electromagnetic actuating device 99 of the yarn remnant scissors 98 has an operative connection 100 with the sequencer 121.

The spinning cops are prepared for their function as payout bobbins in the following manner:

In FIG. 1, spinning cops 101 that are not yet oriented to point upward are raised by the elevator 6, enter the cop inverter 7 one by one in succession, and from there enter the conveyor belt 8. The spinning cops 13 that are already aligned upright, that is with the tops of the bobbin tubes upward, remain in the cop conveyor belt 8. In FIG. 2, the feeder 15 transports the spinning cops 13 individually in succession to the cop delivery station 10. Along the way from the cop inverter 7 to the individual feeder 11 of the cop delivery station 10, the yarn ends are looked for on the surface of the cop with the aid of the blower apparatus 9 and the unwinder 17, transported downward, grasped and unwound. In this process the cops may be rotated about their own axes. Driven, endless round cords 102, 103 seen in FIG. 2 are used for this purpose.

The elevator 6, cop inverter 7, cop conveyor belt 8, individual feeder 11 and feeder 15 all operate at rates that are adapted to one another. The individual feeder 11 has a plunger 104, which presses a spinning cop brought by the feeder 15 down onto the cop retainer 41, unless it already drops by its own weight onto the cop retainer 41.

By this point, the yarn ends of the spinning cops have already undergone a special treatment. At the end of the unwinder rollers 19 and 20 there is a pair of yarn scissors 105, which runs continuously and shortens the yarn ends. The shortened yarn ends are grasped and held firmly by the suction apparatus 22 seen in FIG. 3. This assures that a spinning cop dropping onto the cop retainer 41 will carry its yarn end trailing after it. The trailing yarn end is then aspirated into the suction apparatus 43, as FIG. 2 shows.

FIG. 2 shows the drop chute 37 at the instant it pivots upward into the vertical position, shortly before the cop retainer 41 swivels outward. The drop chute 37 is still empty at that instant.

FIG. 3 shows the drop chute 37 in the vertical position. The cop retainer 41 has been pivoted laterally by the drop chute, so that the spinning cop 40 can drop into the funnel 45. The base of a spinning tube 106 is then located above the mouth of the curved suction tube 63 of the suction apparatus 38.

The light barrier 90 has been switched to measuring the presence of a cop, as long as the spinning cop 40 still rested on the cop retainer 41. However, as soon as the tip of the bobbin tube 106 has moved past the light barrier 90, the cop presence signal ceases, and the combined switching and delay apparatus 94 comes into operation. Once a fixed delay period has elapsed, the light barrier 90 switches over to yarn measurement. The much weaker yarn signal must then be detected. If the presence of a yarn end 42 is ascertained, then the operative connection 113 between the control device 121 and the actuating device 92 remains inactive, and the cop diversion shunt 93 is not pivoted into the path of the transport means 23. However, if the yarn signal is absent, the cop diversion shunt 93 is activated, because in this case the expectation that the spinning cop will be properly prepared does not exist.

The operative connection 100 is likewise activated by the yarn presence sensor 89, through the electronic data processing system 112 and the control device 121. As a result, a trailing yarn end 42 is cut by actuation of the yarn remnant scissors 98. The shortened yarn end 42 drops downward toward the spinning cop 40 and in this process is grasped by the suction air flowing through this spinning cop, or rather its bobbin tube, and is drawn into the tube.

As it made its way to the funnel 45, the cop 40 slid along the device 59 for preventing layers of yarn from being knocked off. The device 59 then rests on the surface of the upper end of the spinning cop 40, as FIG. 3 shows.

The yarn end 42' already aspirated into the bobbin tube can then no longer be unwound to an arbitrary length from the spinning cop 40 under the influence of the suction air. Further unwinding is prevented or hindered by the device 59.

Under sensor control, the drop chute 37 then pivots into the horizontal position. To this end, the crank drive 68 comes into operation. The motion of the crank drive 68 is effected virtually from the bottom dead center position. The pivoting speed takes a sinusoidal course. The pivoting motion begins slowly and also ends slowly. During the pivoting motion, the yarn scissors 64 are actuated. At the same time, the suction air also no longer reacts to the yarn end, which has then been shortened for the second time. Since the spinning cop 40 is brought very gently into the horizontal position, the yarn end cannot be spun frontward out of the bobbin tube 106.

As soon as the spinning cop 40 has attained the horizontal position, the horizontal conveyor 73 comes into operation. Its initial position is shown in FIG. 2. The motion of its transport levers 78 and 79 begins approximately at the top dead center position of the crank drive 84. The travel of the spinning cop 40 to a position 40'' seen on the slide surface 74 in FIG. 2, therefore likewise takes a sinusoidal course. The two transport levers 78 and 79 pivot to the left and right of the chute body 54 through the drop chute 37, as shown in FIG. 4, and in so doing engage the spinning cop 40, which deflects and opens the flaps 55 and 56 resting resiliently against it. Then the spinning cop slides over the slide surface 74 until it is on the transport or conveyor means 23. The transport means 23 only moves at moderate speed, so that there need be no fear of impairment of the aspirated yarn end at that location.

While the transport levers 78 and 79 are moving into a position 79' shown in FIG. 2, the drop chute 37 is pivoted back into the vertical position, as is also shown in FIG. 2. The beginning of the reverse motion is selected in such a way that the horizontal conveyor 73 cannot be harmed. The two crank drives 68 and 84 also operate at the rate of the entire apparatus and are adapted to one another.

There are two options for the operation of the cop preparation station 5:

Either spinning cops are placed on the transport means 23 continuously, or the cop preparation station operates only on demand from the automatic bobbin winder 1. In the first case, any excess spinning cops continually reach the collection box 25. In the second case, the delivery of the properly prepared spinning cops precisely meets the demand of the automatic bobbin winder.

The sequencer 121 mentioned above is a control device of a conventional kind. It operates partly with cam disks or sets of cam disks and partly with electric control relays, switching relays, and with electric contactors, for higher capacity of the motors 119 and 120 connected through lines 117 and 118.

In the sequencer 121, the above-discussed process of treatment and passage of cops onward is achieved in an intrinsically conventional manner in terms of control and circuitry. The following special features associated with the present invention exist:

The electronic data processing system 112 is connected directly to the sequencer 121. FIG. 3 shows that of the integrated circuits (ICs) of the electronic data processing system 112, a total of five integrated circuits 122–126 are especially emphasized. In order to perform the invention, an operating program is integrated into the IC 122, and a substitute program is integrated into the IC 123. Since the integration is preferably to be performed by software, it is a prerequisite that at least the ICs 122 and 123 are programmable in some conventional manner. The circuit 124 located between them serves to switch over from one program to the other and enables a corresponding software emulation, so that it acts as an emulator. The operating program integrated in the IC 122 corresponds to the above-discussed method of treatment and further passage of the cops. The substitute program integrated into the IC 123 is very largely equivalent to the operating program, but is understood to include certain departures, which will be discussed in further detail below. The IC 125 includes a plurality of timer mechanisms, while the IC 126 includes not only a plurality of timer mechanisms but at least one counting mechanism as well.

The operating program integrated into the IC 122 is subdivided into various successive operating steps, like the course of operation discussed above in conjunction with the method. The substitute program integrated into the IC 123 is subdivided into an equal number of operating steps. The emulation is performed in a particular manner, to be discussed in further detail below.

From the above it is clear that failure of the sensor 89 or of its light barrier 90 is particularly serious. In fact, it is provided in the operating program that whenever the light barrier 90 has not responded after a time preset in the IC 125 has elapsed, at the moment that a cop is demanded by the automatic bobbin winder 1 the entire cop preparation apparatus is stopped, because it can be assumed that a major blockage in cop delivery then exists, which would have to cause damage if the cop preparation system were to continue to run. Accordingly, if there is a complete failure of the light barrier 90, all that initially happens is that the cop preparation is put out of operation, while the automatic bobbin winder can, of course, continue to operate. If the disruption is not noticed, the payout bobbin supply available at the various stations of the automatic bobbin winder gradually runs out, so that production gradually drops down to zero. On the other hand, if the functional capability of the light barrier 90 is merely reduced, then although it can still detect the presence of a cop, it can no longer detect the presence of the relatively thin yarn 42. The consequence of this is that the shunt 93 is opened through the line 113. From that instant on, all of the following prepared cops pass over the slide 96 into the collecting container 97. In order to prevent that, the invention provides monitoring means 127 for automatically monitoring the particularly sensitive part of the sensor 89, namely the light barrier 90, for its functional capability. The monitoring means 127 are in the form of a further sensor. The light barrier 90 is disposed in the monitoring range of the further sensor 127. The further sensor 127 directly observes whether or not the light barrier 90 is transmitting an adequate amount of light. The light barrier 90 and the sensor 127 may be of the same type and sensitivity. If a drop in capability occurs because of soiling, then this may make itself felt simultaneously at both sensors, but that would not impair the functional capability of the monitoring sensor. At most, the switchover from the operating program to the substitute program would take place earlier than necessary, but nevertheless continued operation of the automatic bobbin winder would be assured. The sensor 127 is connected to the electronic data processing system 112 by an operative connection 114.

The yarn scissors 64 should not be actuated or the drop chute 37 tilted, until it is certain that a cop has reached the funnel 45. In order to ascertain this and to report it to the electronic data processing system 112, further monitoring means 128 in the form of a further light barrier are provided just above the funnel 45. The light barrier 128 is connected to the electronic data processing system 112 by an operative connection 115. According to the operating program, after a response of a sensor 128, the yarn shears 64 are first actuated over the connection line 66 by the automatic data processing system 112 and the sequencer 121, and then the motor 119 is switched on over the line 117, which actuates the crank drive 68 to pivot the drop chute 37. However, if the sensor 128 fails, the drop chute 37 cannot pivot, and the supply of cops to the automatic bobbin winder 1 ceases. In order to prevent that, continuous monitoring of the sensor 128 is also provided, in the following way:

Monitoring means 129 in the form of a further sensor continuously monitor the sensor 128. The monitoring sensor 129 is connected to the electronic data processing system 112 over an operative connection 116. Since the sensor 128 is likewise intended to be a light barrier, the monitoring sensor 129 need merely continuously monitor whether or not the light barrier 128 is transmitting light. As soon as no light is transmitted, the monitoring sensor 129 immediately causes the switchover from the operating program to the substitute program, in that the duration of this operating step is then determined by time specification on the part of the IC 126 connected to the IC 123.

A further special feature is the manner of switchover from the operating program to the substitute program. This switchover always takes place only for the applicable operating step having the sensor which has failed. Therefore, all of the operating steps in which there is no problem, continue to run according to the operating program. Only the malfunctioning operating steps run according to the substitute program. Due to the speed of switchover, the disruption of the sensors cannot grow to the point that it causes a disruption of the course of operation of the textile machine.

The integrated circuits 125 and 126 can naturally be used as monitoring means at any time, instead of or in addition to the monitoring sensors 127 and 129. The additional use of the switching mechanisms or timer elements contained in the IC 125 leads to redundancy of monitoring without additional expense, solely by suitable programming. To this end, the timer mechanisms are adjusted as follows:

If a predetermined period of time since the emission of a demand signal from the automatic bobbin winder 1 has elapsed, and the sensor 89 or its light barrier 90 has not yet responded, then the switchover to the substitute programs takes place automatically. As soon as the sensor 128 has not responded, from the instant that the automatic bobbin winder has demanded a cop until some later instant than the one just now mentioned, a switchover likewise takes place to the substitute program. The time periods mentioned are dimensioned in such a way that it is assured that the cop must normally have reached the detection range of the monitoring sensors by that time.

In the present instance, the running times of the various operating steps that are definitive for the substitute program are defined beforehand by software through the use of the IC 126.

The electronic data processing system 112 is also of a conventional kind. It has at least one microprocessor, the usual interface and, for example, at least one display unit, alarm devices, and at least one keyboard for entering parameters and for programming.

I claim:

1. Method for operating a textile machine that operates automatically according to an operating program, which comprises:

subdividing a course of operation into individual operating steps;

monitoring at least one of the operating steps with at least one sensor for detecting at least one of presence of an article, absence of an article, movement past the sensor of an article connected to the textile machine, success of an operation and failure of an operation; and tripping an automatic intervention into the course of operation as a function of the outcome of the monitoring step; automatically monitoring a functional capability of the sensor; and automatically switching over from the operating program to a prepared substitute program no longer requiring the sensor for continued operation of the textile machine after failure of the sensor.

2. Method according to claim 1, which comprises operating an automatic bobbin winder according to the operating program.

3. Method according to claim 1, which comprises operating an automatic spinning machine according to the operating program.

4. Method according to claim 1, which comprises defining the duration of an operating step in the context of the substitute program as being fixed, whenever the sensor had previously determined one of the instant of the end of the operating step and the beginning of a new operating step in the context of the operating program.

5. Method according to claim 4, which comprises integrating the programs for the operation of the textile machine by software into an electronic system equipped with at least one microprocessor, and switching over from the operating program to the substitute program by conventional software emulation.

6. Method according to claim 1, which comprises defining the duration of an operating step in the context of the substitute program as being determined by different criteria, whenever the sensor had previously determined one of the instant of the end of the operating step and the beginning of a new operating step in the context of the operating program.

7. Method according to claim 6, which comprises integrating the programs for the operation of the textile machine by software into an electronic system equipped with at least one microprocessor, and switching over from the operating program to the substitute program by conventional software emulation.

8. Method according to claim 1, which comprises integrating the programs for the operation of the textile machine by software into an electronic system equipped with at least one microprocessor, and switching over from the operating program to the substitute program by conventional software emulation.

9. Method according to claim 1, which comprises determining the duration of an operating step in the context of the operating program with a light barrier, and taking over the function of the light barrier with a timer mechanism in the context of the substitute program in the event of a failure of the light barrier.

10. Apparatus for operating a textile machine that operates automatically according to an operating program, comprising:

at least one sensor monitoring at least one individual operating step subdivided from a course of operation for detecting at least one of presence of an article, absence of an article, movement past said sensor of an article connected to the textile machine, success of an operation and failure of an operation;

means for tripping an automatic intervention into the course of operation as a function of the outcome of the monitoring;

means connected to said at least one sensor for operating the textile machine according to an operating program and according to a predetermined substitute program assuring continued operation of the textile machine even if said at least one sensor has failed;

means connected to said operating means for automatically monitoring functional capability of said at least one sensor; and switchover means connected to said monitoring means for switching over textile machine operation from the operating program to the substitute program after a failure of said at least one sensor ascertained by said monitoring means.

11. Apparatus according to claim 10, wherein the textile machine is an automatic bobbin winder.

12. Apparatus according to claim 10, wherein the textile machine is an automatic spinning machine.

13. Apparatus according to claim 10, wherein said at least one sensor is a first sensor, said monitoring means includes a second sensor with a given monitoring range, and said first sensor is disposed within said given monitoring range.

14. Apparatus according to claim 13, wherein said monitoring means has an electronic circuit operatively connected to said first sensor.

15. Apparatus according to claim 10, wherein said monitoring means has an electric circuit operatively connected to said at least one sensor to be monitored.

16. Apparatus according to claim 10, wherein said monitoring means includes a time switching mechanism for monitoring duration of at least one substep of said sensor-monitored operating step.

17. Apparatus according to claim 10, including duration-limiting sensor means operating according to the operating program for limiting a duration of an operating step and non-sensor time specification means operating according to the substitute program, said operating means replacing operation of said duration-limiting sensor means with said non-sensor time specification means during substitute program operation.

18. Apparatus according to claim 17, wherein said non-sensor time specification means is a timer mechanism.

19. Apparatus according to claim 10, wherein said operating means are an electronic system equipped with at least one processor into which the programs for the operation of the textile machine are integrated, said electronic system having a circuit for enabling software emulation for a transition from the operating program to the substitute program.

20. Apparatus according to claim 19, wherein the programs for the operation of the textile machine are integrated by software into said electronic system.

21. Apparatus according to claim 10, wherein said operating means are an electronic system equipped with at least one processor into which the programs for the operation of the textile machine are integrated, said electronic system having an emulator for enabling software emulation for a transition from the operating program to the substitute program.

22. Apparatus according to claim 21, wherein the programs for the operation of the textile machine are integrated by software into said electronic system.

* * * * *